US010228097B2

(12) United States Patent
Snijkers

(10) Patent No.: US 10,228,097 B2
(45) Date of Patent: Mar. 12, 2019

(54) RETROFIT LIGHTING ASSEMBLY

(71) Applicant: PHILIPS LIGHTING HOLDING B.V., Eindhoven (NL)

(72) Inventor: Robertus Johannes Maria Mathilde Snijkers, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/124,415

(22) PCT Filed: Mar. 13, 2015

(86) PCT No.: PCT/EP2015/055373

§ 371 (c)(1),
(2) Date: Sep. 8, 2016

(87) PCT Pub. No.: WO2015/136110

PCT Pub. Date: Sep. 17, 2015

(65) Prior Publication Data

US 2017/0016584 A1 Jan. 19, 2017

(30) Foreign Application Priority Data

Mar. 13, 2014 (EP) ..... 14159321

(51) Int. Cl.
*F21K 2/06* (2006.01)
*F21K 9/275* (2016.01)
(Continued)

(52) U.S. Cl.
CPC ..... *F21K 9/275* (2016.08); *F21K 9/278* (2016.08); *F21S 8/026* (2013.01); *F21V 3/00* (2013.01);
(Continued)

(58) Field of Classification Search
CPC ..... F21K 9/275; F21K 9/278; F21V 7/005; F21V 7/10; F21V 7/22; F21V 17/16; F21V 23/007; F21V 23/0442; F21V 23/0457
(Continued)

(56) References Cited

U.S. PATENT DOCUMENTS 1,944,707 A * 1/1934 Clayton ..... H02G 3/085 220/274
5,803,589 A 9/1998 Lee
(Continued)

FOREIGN PATENT DOCUMENTS

DE 833669 C1 3/1952
DE 202012103840 U1 1/2013
(Continued)

OTHER PUBLICATIONS http://www.ledbuys.com/store/index.php?mail_page=index&cPath=754; CREE True White Technology, two pages, printed Jun. 28, 2013.
(Continued)

*Primary Examiner* — Paultep Savusdiphol
(74) *Attorney, Agent, or Firm* — Akarsh P. Belagodu

(57) ABSTRACT

A lighting assembly (100) adapted to be mounted in a lighting fixture is provided. The lighting assembly comprises at least four sidewall parts (110, 112, 114, 116), a fastening arrangement (122, 124) adapted to secure the sidewall parts to each other, and at least one light emitting element (130). The sidewall parts are adapted to be arranged in the lighting fixture and secured to each other such that they define sidewalls of a four-sided cavity. Further, junctions between the sidewall parts are arranged to be at the corners of the four-sided cavity when the sidewall parts are arranged in the lighting fixture. Each one of at least two of
(Continued)

the sidewall parts comprises a support surface (111, 113, 115, 117) adapted to support the lighting assembly in the lighting fixture and to be arranged at different sides of the four-sided cavity when the sidewall parts are arranged in the lighting fixture. Thereby, a lighting assembly that is easier to install is achieved.

14 Claims, 6 Drawing Sheets

(51) Int. Cl.

| | |
|---|---|
| ***F21V 3/00*** | (2015.01) |
| ***F21S 8/02*** | (2006.01) |
| ***F21V 7/00*** | (2006.01) |
| ***F21V 7/10*** | (2006.01) |
| ***F21V 17/16*** | (2006.01) |
| ***F21V 23/00*** | (2015.01) |
| ***F21V 23/04*** | (2006.01) |
| ***F21K 9/278*** | (2016.01) |
| ***F21V 17/10*** | (2006.01) |
| *F21V 7/05* | (2006.01) |
| *F21Y 115/10* | (2016.01) |
| *F21V 7/22* | (2018.01) |

(52) U.S. Cl.
CPC ..... *F21V 7/005* (2013.01); *F21V 7/10* (2013.01); *F21V 17/108* (2013.01); *F21V 17/16* (2013.01); *F21V 23/003* (2013.01); *F21V 23/007* (2013.01); *F21V 23/0442* (2013.01); *F21V 23/0464* (2013.01); *F21V 23/0471* (2013.01); *F21V 7/05* (2013.01); *F21V 7/22* (2013.01); *F21V 23/0457* (2013.01); *F21Y 2115/10* (2016.08)

(58) Field of Classification Search
USPC ..... 362/221, 217.02, 217.1, 296.01, 341
See application file for complete search history.

(56) References Cited

U.S. PATENT DOCUMENTS

| | | | | |
|---|---|---|---|---|
| 6,464,378 | B1 * | 10/2002 | Reed | F21V 7/10 362/297 |
| 6,739,734 | B1 | 5/2004 | Hulgan | |
| 2007/0070633 | A1 | 3/2007 | Eynden | |
| 2012/0169507 | A1 | 7/2012 | Dyer et al. | |
| 2013/0039047 | A1 * | 2/2013 | Kim | F21L 4/02 362/184 |
| 2013/0135875 | A1 | 5/2013 | Schutte et al. | |

FOREIGN PATENT DOCUMENTS

| | | | |
|---|---|---|---|
| EP | 2280212 | A1 | 2/2011 |
| EP | 2527729 | A1 | 11/2012 |
| JP | 2003007127 | A | 1/2003 |
| JP | 2013118063 | A | 6/2013 |

OTHER PUBLICATIONS

Philips Evokit Video 2, Philips Counter Videos for US Distribution Channel, Dec. 2013 (4 Pages).
Hi-Lite Electric, New LED Lay in Troffer Kit, Hi-Lite Electric Energy Efficient Lighting, Mar. 2014 (4 Pages).

* cited by examiner

RETROFIT LIGHTING ASSEMBLY

CROSS-REFERENCE TO PRIOR APPLICATIONS

This application is the U.S. National Phase application under 35 U.S.C. § 371 of International Application No. PCT/EP2015/055373, filed on Mar. 13, 2015, which claims the benefit of European Patent Application No. 14159321.0, filed on Mar. 13, 2014. These applications are hereby incorporated by reference herein.

FIELD OF THE INVENTION

The present invention generally relates to the field of lighting assemblies adapted to be mounted in lighting fixtures.

BACKGROUND OF THE INVENTION

Fluorescent tube luminaires are widely used for illumination of e.g. commercial office spaces, schools, and lab facilities. Such luminaires are often arranged in a dropped ceiling, i.e. a secondary ceiling hung below the main, structural ceiling. A dropped ceiling may consist of a metal grid structure defining regularly spaced cells, e.g. having the dimensions of 2×4, 2×2 or 1×4 feet, which cells can be filled with tiles or panels so as to provide a flat surface hiding the space above the dropped ceiling.

A fluorescent tube luminaire may be accommodated in a cell of the dropped ceiling. In general, the luminaire may comprise a lighting fixture, or troffer, and optical elements enabling a desired optical performance. The luminaire may be recessed above the dropped ceiling grid and adapted to accommodate one or several fluorescent tubes. It is also common to provide light fixtures that fit the same space as a tile in order to facilitate installation.

Today, there is a growing demand for replacing fluorescent tubes with less energy consuming illumination devices, such as e.g. light emitting diode (LED) based illumination devices. Aspects of a kit for replacing fluorescent tubes in a fluorescent tube luminaire with a plate-like LED based lighting system are discussed in JP 2013/118063. That document describes a LED system that makes use of existing light fixtures, wherein the fluorescent tubes are replaced with two rods that are fixated to the sockets of the fixtures. A flat LED unit is then attached to the light fixture by means of L-shaped hooks that engage with the rods.

Although such LED-lighting systems can be used for replacing fluorescent tubes, there is still a need for improved kits that are easier to install in the lighting fixture.

SUMMARY OF THE INVENTION

It would be advantageous to achieve a lighting assembly that is easier to install.

To better address this concern, a lighting assembly and a method for mounting such assembly with the features of the independent claims is provided. The dependent claims define preferable embodiments.

Hence, according to a first aspect, a lighting assembly adapted to be mounted in a lighting fixture is provided. The lighting assembly comprises at least four sidewall parts, a fastening arrangement adapted to secure the sidewall parts to each other, and at least one light emitting element. The sidewall parts are adapted to be arranged in the lighting fixture and secured to each other such that they define sidewalls of a four-sided cavity. Further, junctions between the sidewall parts are arranged to be at the corners of the four-sided cavity when the sidewall parts are arranged in the lighting fixture. At least one of the sidewall parts has a predefined sensor mounting position (180) and a predefined control module mounting position (190). Each one of at least two of the sidewall parts comprises a support surface adapted to support the lighting assembly in the lighting fixture and to be arranged at different sides of the four-sided cavity when the sidewall parts are arranged in the lighting fixture. Further, the light emitting element is arranged to emit light out of the four-sided cavity.

According to a second aspect, a method for mounting a lighting assembly according to the first aspect is disclosed. The method comprises arranging the at least four sidewall parts in the lighting fixture and securing the sidewall parts to each other by means of the fastening arrangement such that junctions between the sidewall parts are arranged at the corners of the four-sided cavity, and such that the support surfaces supports the lighting assembly in the lighting fixture.

The lighting fixture (which also may be referred to as a troffer) may be originally intended for a fluorescent tube and may e.g. be installed above a grid in a dropped ceiling. The lighting assembly according to the present aspects may be used for replacing the fluorescent tube and/or the optical elements that fit to the fluorescent tube in such a lighting fixture. The lighting fixture and the lighting assembly may together form a luminaire.

By assembling the lighting assembly from at least four separate sidewall parts adapted to form junctions at the corners of the four-sided cavity and which may not necessarily be secured to each other until they are arranged in the lighting fixture, relatively large lighting assemblies can be arranged at lighting fixtures even though the available mounting space is relatively limited. Even though the mounted lighting assembly may be larger than e.g. the opening of the grid, i.e. have a length exceeding the length of the opening of the grid and a width exceeding the width of the opening of the grid, the lighting assembly may be inserted in the lighting fixture by arranging the sidewall parts in the lighting fixture one by one and subsequently securing them to each other. Thereby, a lighting assembly being slightly larger than the opening in the grid or the lighting fixture can be used, and the installation of the lighting assembly may be facilitated.

The support surfaces of the sidewall parts may engage with the lighting fixture or with the grid, such as the upper surface of a rim forming an opening of the grid, so as to support the lighting assembly in the lighting fixture. The support surfaces may be formed such that the total length and width of the lighting assembly may render it difficult to insert a mounted lighting assembly in the grid. Being able to mount such lighting assembly in pieces or modules further enables the lighting assembly to (at least almost) fully cover the opening in the cell of the grid. Thereby, the space above the grid of the dropped ceiling may be hidden for a viewer observing the ceiling.

The sidewall parts being adapted to be secured to each other by the fastening arrangement provide a modular lighting assembly comprising relatively few module components, whereby manufacturing, handling, and mounting of the lighting assembly is facilitated.

One or several light emitting elements may be arranged in the cavity at one or several sidewall parts. By adapting the shape and/or design of the sidewall parts and hence the cavity, a desired illumination pattern in terms of spreading, direction, distribution angle etc. of light emitted out from the cavity may be achieved.

The lighting assembly may e.g. be a retrofit lighting assembly. Such retrofit lighting assembly may e.g. be used for modification or conversion of a luminaire already in use. As an example, a luminaire may be converted from an incandescent, fluorescent, or high intensity discharge light source into a LED light source.

In the present specification, the term "junction" between the sidewall parts may refer to an intersection or boundary between neighboring sidewall parts. The junction may e.g. extend from a position close to the rim of the cavity towards the top wall, or roof, of the cavity. It will however be appreciated that neighboring sidewall parts not necessarily have to physically abut each other at the junction; the junction may just as well be defined as the point, line or area in which an imaginary extension of a first and a second sidewall part meet, or intersect. Further, the term "corner" of the cavity may refer to the boundary or area where two neighboring sides of the four-sided cavity (at least almost) meet. Hence, the four-sided cavity comprises four corners.

According to an embodiment, the lighting assembly may comprise a diffuser arranged to diffuse light emitted by the light emitting element. The diffuser may be adapted to spread the light that is output from the cavity so as to provide a soft, diffuse lighting. Hence, by using a diffuser, the homogeneity and distribution of the illumination may be improved. Advantageously, the diffuser may be arranged to cover the light emitting element and/or the sidewall parts so as improve the visual appearance of the lighting assembly. The diffuser may also be arranged to cover possible gaps between the sidewall parts the grid or lighting fixture so as to achieve a ceiling having a relatively smooth and flat surface.

According to an embodiment, the fastening arrangement may comprise at least one protruding member being integrally formed with at least one of the sidewall parts and at least one receiving member being integrally formed with at least another of the sidewall parts. The protruding member is adapted to engage with the receiving member in order to secure the sidewall parts to each other. Thereby, facilitated fitting of the sidewall parts may be achieved, as the number of required additional components or material such as screws, rivets etc. is reduced. The fastening arrangement according to the present embodiment allows the sidewall parts to be secured to each other by simply inserting the protruding member into the receiving member upon/after the sidewall parts are arranged in the lighting fixture which may shorten the time required for installation.

The protruding member and the receiving member being integrally formed with the sidewall parts also enables for a facilitated manufacturing process since they can be formed at the same time as the sidewall parts are formed. Thereby, the number of steps and tools of the manufacturing process, as well as the bill of material, may be reduced.

It will however be appreciated that the sidewall parts may be engaged to each other by means of other fastening arrangements which may be integrally formed with the sidewall parts or form elements that are structurally distinct from the sidewall parts. Examples of other fasting arrangements may include clips, clamps, pins, magnets, etc.

According to an embodiment, the protruding member of the fastening arrangement may comprise a tab and the receiving member may comprise a slit. The tab is adapted to be inserted in the slit and bent so as to secure the sidewall parts to each other. By bending the tab, e.g. by hand or by means of pliers, a mechanical joint between the sidewall parts may be achieved. The bendable tab may also enable disassembling of the lighting fixture. By letting the tab assume its original shape, it may be removed from the slit and the sidewall parts loosened from each other. The tab may be formed of a material and/or having a shape allowing the tab to be bent several times without being impaired by fatigue or wear, thereby allowing the lighting assembly to be repeatedly installed and removed. Being able to reuse or re-install a lighting assembly a plurality of times may advantageously facilitate e.g. repairing, service, and maintenance of the luminaire, the lighting assembly, or the lighting fixture. The use of a bendable tab may also enable future adjustment of the illumination device, such as e.g. adjustment of the securing of the sidewalls and the fitting tolerance in the lighting fixture.

The tab and the slit may also be adapted to allow for the dimensions of the cavity to be adjusted so as to improve the fitting in the lighting fixture and/or the grid. This may e.g. be achieved by varying the length of the tab that is inserted in the slit and bent. As an example, a cavity being formed of sidewall parts that are secured to each other by tabs being fully inserted in the slit may be smaller than a cavity whose sidewall parts are secured by tabs that are only partly inserted in the slits. Consequently, by varying the length of insertion of the tabs, there may be provided an adjustable gap between neighboring sidewall parts, which gap can be used for adjusting the dimensions of the cavity. In other words, being able to vary the length of the inserted (and bent) tab so as to adjust the distance between joint sidewall parts allows for a lighting assembly having increased dimensional tolerance range.

Thus, the present embodiment enables a more flexible and robust lighting assembly that can be used with lighting fixtures and/or grids of slightly various sizes.

According to an embodiment, at least one (and preferably all) of the at least four sidewall parts is formed by sheet material, such as a sheet metal. Sheet materials, and in particular sheet metals, are advantageous in that they may be cut and bent into a variety of shapes with relative ease. A sheet material may also allow for sidewall parts that are relatively form stable and light weight, which may facilitate production and installation of a lighting assembly with an improved robustness and reliability. Further, a sheet material having relatively high heat conductivity may be used in order to provide a heat sink capable of dissipating heat energy generated by the light emitting element.

According to an embodiment, at least one of the support surfaces may be integrally formed with the sidewall part. Thereby, a facilitated manufacturing process can be obtained, in which the support surface may be formed at the same time as the sidewall parts are formed. This allows for a reduced number of steps and tools of the manufacturing process, as well as a reduced bill of material.

According to an embodiment, at least one of the support surfaces may be adapted to engage with (such as rest on) a frame arranged at a rim of the lighting fixture so as to support the lighting assembly at the lighting fixture. During assemblage, the at least one sidewall part may be arranged in the lighting fixture such that the support surface, and hence the at least one sidewall part, is resting on an upper surface of the frame. Thereby, the lighting assembly relatively easily and quickly can be mounted and supported in the lighting fixture. The frame may e.g. be a part of a grid (such as a cell of a grid) used as a support structure in a dropped ceiling.

The support surface may e.g. be arranged to engage with the frame such that the lighting assembly (at least almost) covers an opening defined by the frame, whereby any space or gap between the frame and the lighting assembly is reduced or even eliminated. Thereby, the space above the lighting assembly and/or lighting fixture may be hidden from a viewer observing the ceiling.

According to an embodiment, the support surface may comprise a protruding flange of the sidewall part. For example, an edge of the sidewall part may be folded so as to form the support surface. Thereby, a relatively robust and stable assembly is enabled, having a reduced risk of coming loose from the lighting fixture.

According to an embodiment, the lighting assembly may comprise a reflective surface adapted to reflect light emitted by the light emitting element out of the cavity. For example, at least a portion of the cavity may act as a reflector re-directing light emitted by the light source out of the cavity. By adapting the configuration of the reflective surface, the illumination output may be controlled, or at least modified, so as to achieve an illumination having a desired beam angle, distribution, pattern, intensity etc. Further, the reflective surface may improve the efficiency of the emitted light and reduce losses due to e.g. absorption in the cavity.

The reflective surface may be formed of a bulk material (i.e. the material of which the sidewall part is formed, such as e.g. a sheet metal) having a relatively high coefficient of reflection. The surface may also be provided by e.g. polishing of the material prior to forming the sidewall portion, prior to mounting the portions, and/or after the lighting assembly is installed. The reflective surface portion may also be provided by an at least partially light reflecting coating which may be applied prior to or after the sidewall portions are formed. Such coating may also be applied after the lighting assembly is installed.

According to an embodiment, the light emitting element may comprise a LED. However, the term "light emitting element" may refer to any device or element that is capable of emitting radiation in any region or combination of regions of the electromagnetic spectrum, for example the visible region, the infrared region, and/or the ultraviolet region, when activated e.g. by applying a potential difference across it or passing a current through it. Therefore, a light-emitting element can have monochromatic, quasi-monochromatic, polychromatic or broadband spectral emission characteristics. Each light-emitting element may have at least one light source. Examples of light sources include semiconductor, organic, or polymer/polymeric light-emitting diodes (LEDs), blue LEDs, optically pumped phosphor coated LEDs, optically pumped nano-crystal LEDs or any other similar devices as would be readily understood by a person skilled in the art. Furthermore, the term light-emitting element can be used to define a combination of the specific light source that emits the radiation in combination with a housing or package within which the specific light source or light sources are placed. For example, the term light emitting element may comprise a bare LED die arranged in a housing, which may be referred to as a LED package.

According to an embodiment, at least one of the four sidewall parts is suitable for locating a control system, that is to say, a sensor and a control module. The sensor may be one of; an occupancy sensor for detecting the presence of a person within the space to be illuminated, an ultrasonic sensor, an infrared sensor, a pressure sensor, temperature sensor, a camera, an ambient light level sensor.

Presence detection in this context means that a lighting system that is equipped with a sensor can detect whether a person is in the room or within the reach of the lighting system.

Daylight harvesting may be utilised, this means that the lighting system senses the ambient light level (usually the daylight brightness) and then adapts the level of the light emitted by the lighting system in such a way that the total light level (the sum of the sensed ambient light level and the light emitted by the lighting system) is according to a predefined set level.

The control module (also known as a control driver) provides the necessary power to the sensor to enable to sensor to function and it also receives the output from the sensor and then, based on the output of the sensor and a control algorithm tailors the input to the light emitting element(s) to adjust the light output by the light emitting element to suit the sensed conditions.

The sensor and control module may be pre-installed on at least one of the four sidewall parts.

The pre-installed sensor and control sidewall parts may be supplied as a retrofit upgrade to allow a user to simply increase the functionality of the lighting assembly by removing a sidewall part which does not have the sensor and control module pre-installed and substituting it with a sidewall part which does have the sensor and control module installed. The user or installer has to connect the control module to the driver which supplies the electrical power to the light emitting element(s).

According to an embodiment, the sensor and control module may be supplied as loose parts and at least one of the four sidewall parts is configured in such a way that the sensor and the control module may be added easily by the user or installer. In an embodiment, a sidewall part has preformed openings suitable to locate the sensor and control module, these preformed openings may be closed by a plastic or metal part that can be easily removed during sensor and control module installation.

In another embodiment the sidewall part has the outline of the holes formed in such a way that the material that forms the center of the holes is mechanically stable enough to resist falling out but is still able to be pushed out easily by the user or installer to allow the addition of the sensor and control module. This may be achieved in a variety of known ways, for example, a small portion of the corners may be left uncut whilst the regions between the corners are cut. In the case of a circular opening, one small region of the circumference being left intact (i.e., uncut) may be suitable for the same outcome.

It is important that the positioning of the opening within the sidewall parts for the sensor is such that the sensor will not be positioned behind or blocked by any other part during the operation of the lighting assembly.

The positioning of the opening for the control module within the sidewall parts should be such that entry for the control module is not blocked by any other part and that the final location for the control module is preferably behind the diffuser so that it is not visible to a viewer.

Preferably, the connection between the sensor and the control module and the control module and the light emitting element driver is completed using snap connectors, this has the added advantage of being easy to use and also, if the different connectors are designed such that they only cooperate with the corresponding connector to allow safe operation of the lighting assembly it reduces the risk of miswiring.

It is noted that embodiments of the invention relates to all possible combinations of features recited in the claims. Further, it will be appreciated that the various embodiments described for the lighting assembly are all combinable with embodiments of the method as defined in accordance with the second aspect.

BRIEF DESCRIPTION OF THE DRAWINGS

These and other aspects will now be described in more detail with reference to the appended drawings showing embodiments, in which.

All the figures are schematic, not necessarily to scale, and generally only show parts which are necessary in order to elucidate the embodiments, wherein other parts may be omitted or merely suggested. Like reference numerals refer to like elements throughout the description.

DETAILED DESCRIPTION

The present aspects will now be described more fully hereinafter with reference to the accompanying drawings, in which currently preferred embodiments are shown. This invention may, however, be embodied in many different forms and should not be construed as limited to the embodiments set forth herein; rather, these embodiments are provided for thoroughness and completeness, and fully convey the scope of the present aspect to the skilled person.

Figure 1:
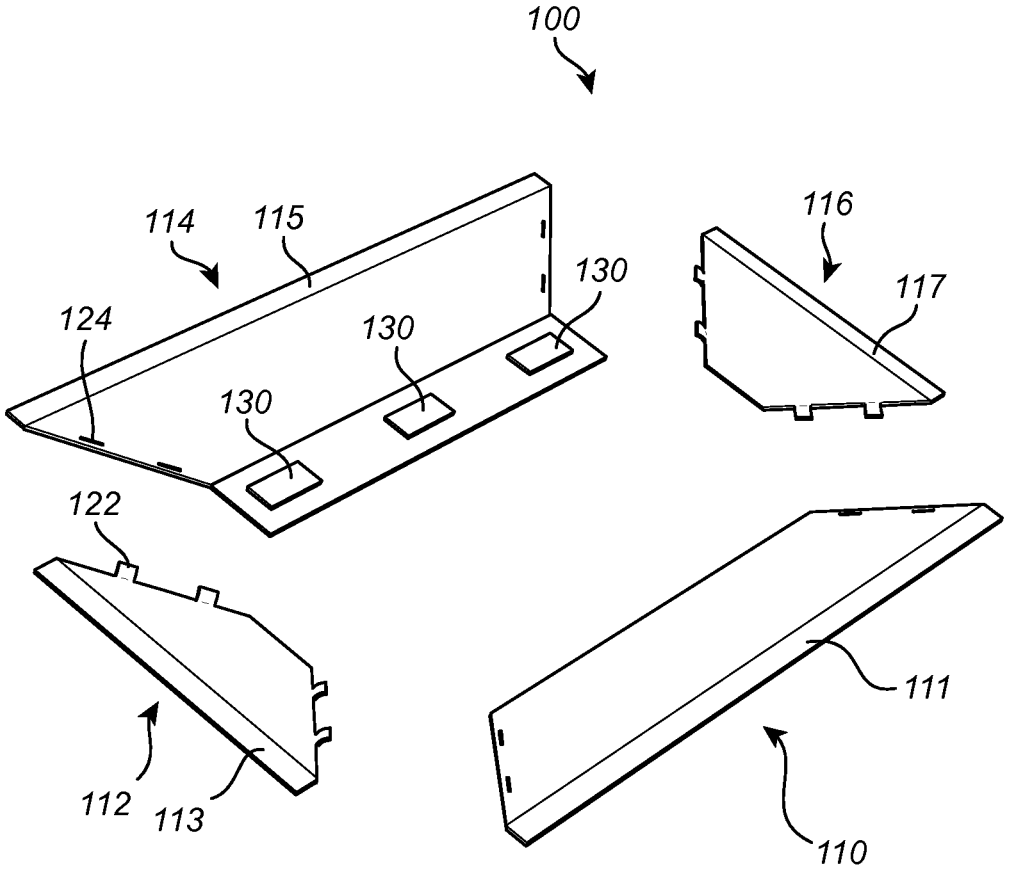
FIG. 1 is a bottom plan view of an unassembled lighting assembly according to an embodiment.

With reference to FIG. 1, there is shown an exploded bottom plan view of a lighting assembly 100 according to an embodiment. The lighting assembly 100 comprises a first and a second longitudinal sidewall part 110, 114, a first and a second lateral sidewall part 112, 116, fastening arrangements 122, 124, and three light emitting elements 130.

The sidewall parts 110, 112, 114, 116 are formed of a sheet metal that is cut and bent into the desired shape. As shown in FIG. 1, the two longitudinal sidewall parts 110, 114 are secured to the two lateral sidewall parts 112, 116 by means of the fastening arrangements 122, 124 so as to form a four-sided cavity. In this embodiment, each sidewall part 110, 112, 114, 116 represents a sidewall of the cavity, wherein the second longitudinal sidewall part 114 also forms a top wall, or roof, of the cavity. The sidewall parts 110, 112, 114, 116 are provided with a peripheral rim that is bent (the fold is indicated by dashed lines in the figure) to form support surfaces, or protruding flanges 111, 113, 115, 117. In other words, each one of the sidewall parts 110, 112, 114, 116 may be described as a flat sheet metal piece that has been bent into an essentially plain portion forming a side of the cavity and a protruding flange 111, 113, 115, 117 adapted to support the lighting assembly 100 in a lighting fixture (not shown). However, it will be appreciated that the sidewall parts 110, 112, 114, 116 may be formed of other material, such as e.g. polymers, by other techniques, such as e.g. injection molding, and into other shapes, such as e.g. a curved profile. Further, the dimensions of the sidewall parts 110, 112, 114, 116 may be adapted to fit into wide variety of lighting fixtures and grids 160 of various widths and lengths.

According to the embodiment as shown in FIG. 1, the three light emitting elements 130 (e.g. LEDs), are arranged on the second longitudinal sidewall part 114. The LEDs 130 may e.g. be preassembled on the second longitudinal sidewall part 114 in order to facilitate and speed up the installation of the lighting assembly 100.

The sidewall parts 110, 112, 114, 116 are adapted to be assembled upon insertion of the lighting assembly 100 in the lighting fixture and secured to each other by means of the fastening arrangement 122, 124. The fastening arrangement 112, 124 may comprise protruding members, such as tabs 122 that are integrally formed with e.g. the lateral sidewall parts 112, 116, and receiving members, such as slits 124 that are cut out from the longitudinal sidewall parts 110, 114. The tabs may e.g. be formed by cutting and bending as the lateral sidewall portions 112, 116 are formed. Similarly, the slits 124 may be cut out during manufacturing of the longitudinal portions 110, 114. The slits 124 may have a shape, or geometry, that corresponds to a cross section of the tabs 122 in order to allow the tabs 122 to be inserted through the corresponding slits 124. Further, the tabs 122 may be adapted to be deformed after being inserted through the slits so as to fix the sidewall parts 110, 112, 114, 116 to each other. The tabs 122 may e.g. be plastically deformed by bending, folding or wrenching into a shape that prevents the tabs from being loosened from the slits. Alternatively or additionally, the protruding members may be secured to the receiving members by other means, such as e.g. clenching, gluing, screwing, etc.

When the sidewall parts 110, 112, 114, 116 are secured to each other, they are arranged such that a peripheral portion of a sidewall part 110, 112, 114, 116 meets a peripheral portion of another one of the sidewall parts, thus forming a junction between the sidewall parts 110, 112, 114, 116 that is arranged at one of the four corners of the cavity.

As each of the four flanges 111, 113, 115, 117 may be arranged to engage with e.g. the lighting fixture or a grid of a dropped ceiling, all four sides of the lighting assembly 100 may be supported in the lighting fixture. However, the lighting assembly 100 may comprise only two or three support surfaces. In case only two support surfaces are provided, each support surface may be arranged at different sides of the four-sided cavity, such as at opposing sides, so as to make the fixation of the lighting assembly 100 more stable. As an example, the first and second longitudinal sidewall parts 110, 114 may be provided with support surfaces whereas the first and second lateral sidewall parts 112, 116 may not.

Figure 2:
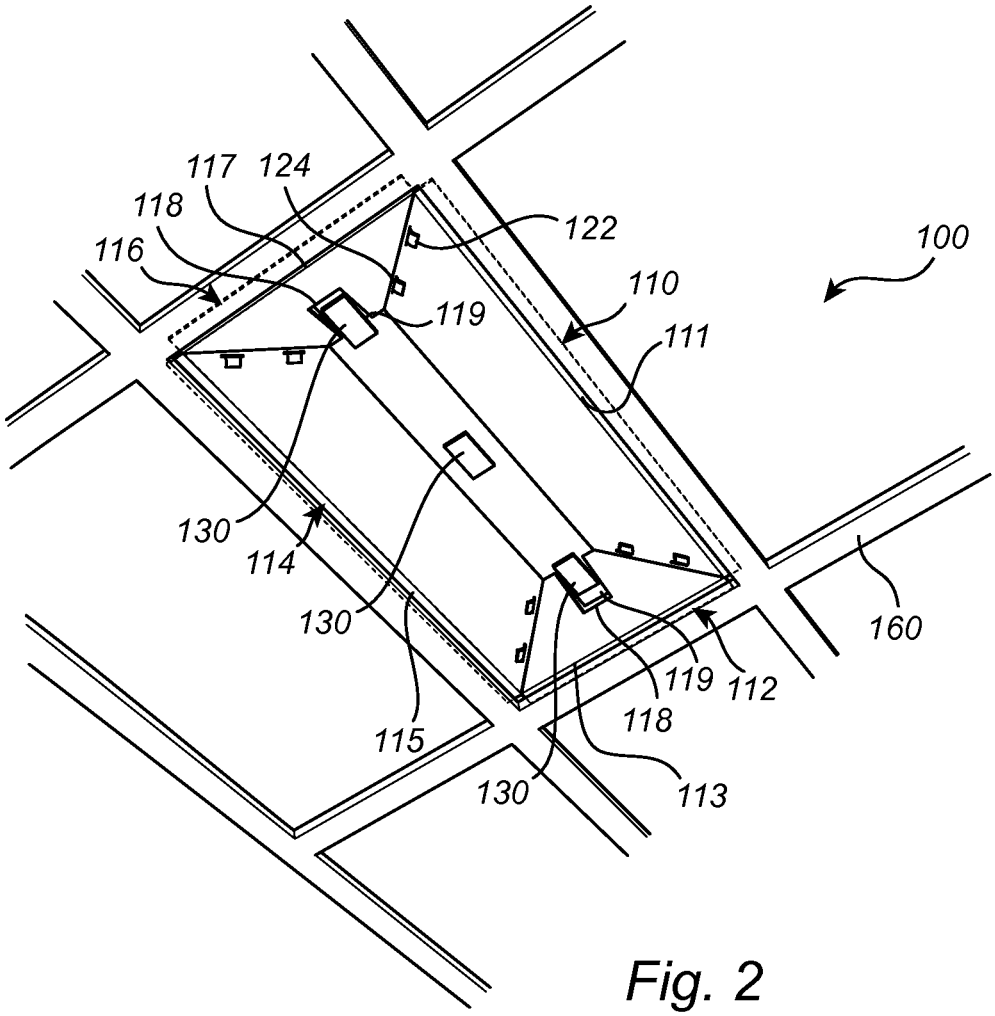
FIG. 2 is a bottom plan view of an assembled lighting assembly according to another embodiment.

FIG. 2 shows a bottom plan view of an assembled lighting assembly 100 according to another embodiment. The lighting assembly 100 may be similarly configured as the lighting assembly 100 described with reference to FIG. 1, but according to this embodiment, each of the lateral sidewall parts 112, 116 are provided with a recess 118 for receiving a protrusion 119 of the second longitudinal sidewall part 114, respectively. By arranging light emitting elements, such as LEDs 130, on the protrusion, the LEDs 130 may be positioned closer to the lateral side of the cavity. Thereby, the light emitted out of the cavity may be better distributed along the longitudinal extension of the lighting assembly 100. However, it will be appreciated that the placement of the light emitting elements 130 by no means is limited to the second longitudinal sidewall portion 114, the light emitting elements 130 may be arranged on any sidewall part 110, 112, 114, 116. Consequently, any of the sidewall parts 110, 112, 114, 116 may be provided with a recess 118 adapted to receive a protrusion 119 from any other sidewall part in order to provide a desired distribution of the emitted light.

In FIG. 2, the outline of a grid 160 of a dropped ceiling is indicated to illustrate an example of a lighting assembly 100 being supported by four flanges 111, 113, 115, 117 on the grid 100. The dimensions of the flanges 111, 113, 115, 117 may be adapted to (at least almost) fully cover the gaps between the lighting assembly 100 and the grid 160 or lighting fixture. The sidewall parts 110, 112, 114, 116 are secured to each other by means of the tabs 122 of the lateral sidewall parts 112, 116 which engage with the slits 124 of the longitudinal sidewall parts 110, 114. As shown in FIG. 2, the tabs 124 may be bent or folded, after being fit into the slits 122, so as to prevent the sidewall parts 110, 112, 114, 116 from coming loose from each other.

The sidewall parts 110, 112, 114, 116 may be arranged in the lighting fixture one by one and subsequently secured to each other by the fastening arrangement 122, 124. Even though the mounted lighting assembly 100 may be slightly larger than e.g. the opening of the grid 160, the lighting fixture or the opening of a frame of the lighting fixture, the lighting assembly 100 may still be inserted in the lighting fixture by assembling the sidewall parts 110, 112, 114, 116 one by one in the lighting fixture. As an example, the lighting assembly 100 in FIG. 2 is provided with circumferential flanges 111, 113, 115, 117, which due to the length and width of the lighting assembly 100 may render it difficult to insert a pre-mounted lighting assembly 100 in the grid 160. However, the lighting assembly 100 may be inserted in the lighting fixture in pieces or modules, such as sidewall part by sidewall part, which then may be secured to each other once they are inserted. As a result, a lighting assembly 100 having a circumferential periphery slightly larger than the opening in the grid 160, or a corresponding opening in the lighting fixture or in a frame arranged at the lighting fixture, can thereby be mounted in the lighting fixture.

Figure 3:
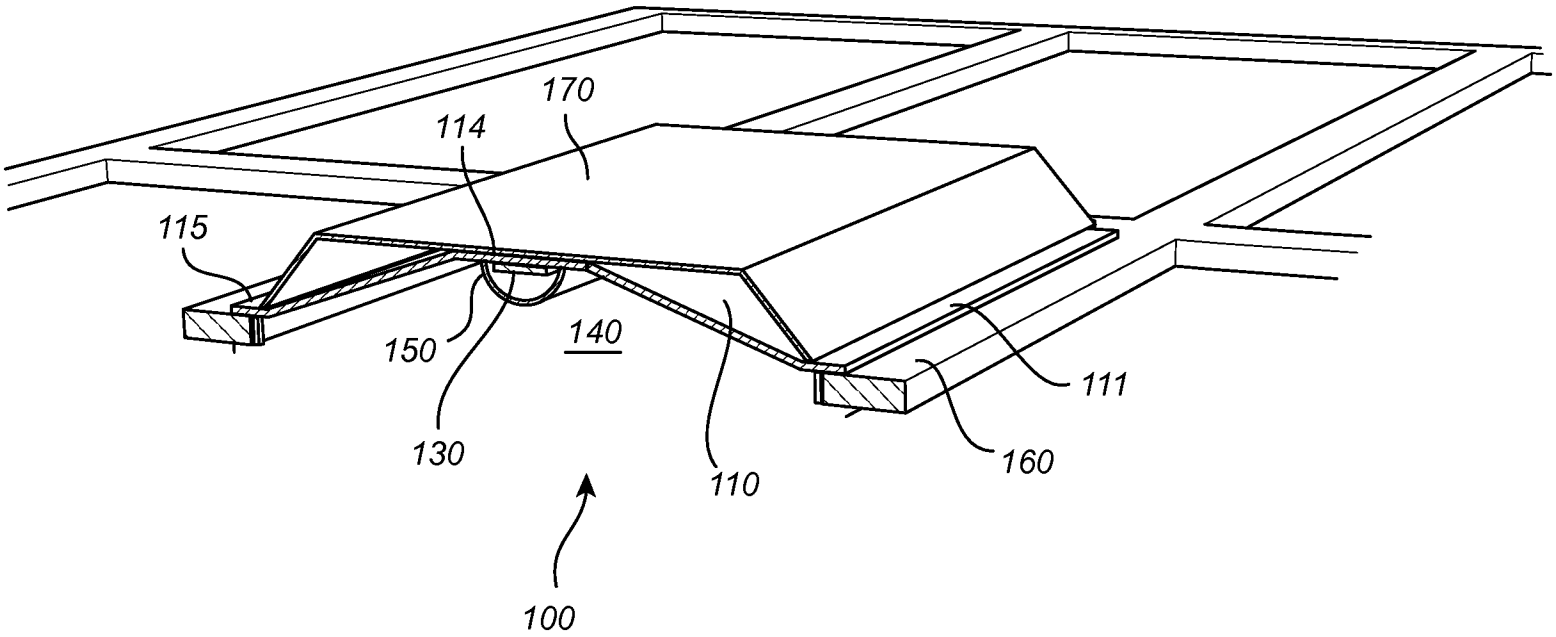
FIG. 3 is a cross sectional perspective view of a mounted lighting assembly.

FIG. 3 is a perspective, cross sectional view of a lighting assembly 100 similarly configured as the lighting assemblies 100 described with reference to FIGS. 1 and 2 mounted in a lighting fixture 170. The cross section of the lighting assembly 100 is taken across the longitudinal sidewall parts 110, 114 and shows a LED 130 arranged on the second longitudinal sidewall part 114 to emit light within the four-sided cavity 140 defined by the sidewall parts 110, 112, 114, 116.

Each of the longitudinal sidewall portions 110, 114 comprises a protruding flange 111, 115 which is adapted for supporting the lighting assembly 100 in the lighting fixture. As shown in FIG. 2, the flanges 111, 115 rest on the upper surface of a grid 160 of a dropped ceiling, in which the luminaire, comprising the lighting assembly 100 and the lighting fixture 170, is recessed.

Further, the embodiment of the lighting assembly 100 shown in FIG. 3 comprises a diffuser 150 arranged to diffuse the light emitted by the LEDs 130. The diffuser 150 may e.g. by secured to the sidewall parts 110, 112, 114, 116 of the lighting assembly 100, the grid 160, or the lighting fixture 170. The fixation may e.g. be realized by means of protruding and receiving members similar to those previously discussed, or by fastening means such as clips, screws, etc. The present diffuser 150 may e.g. be formed of a rectangular plate that is curved in one direction so as to conform with the envelope surface of a cylinder. Thereby the diffuser 150 may be arranged to (at least almost) cover the LEDs 130 of the lighting assembly 100 and hence improve the visual appearance of the lighting assembly 100. The diffuser 150 may also be slightly larger than the opening, or cell, defined by the grid 160 in order to partially or fully cover the opening of the cavity 140 such that neither the other parts of the lighting assembly 100 nor the lighting fixture 170 are visible to a viewer observing the ceiling. The diffuser 150 may be flat so as to provide a flat lower or inner surface of the ceiling.

Figure 4:
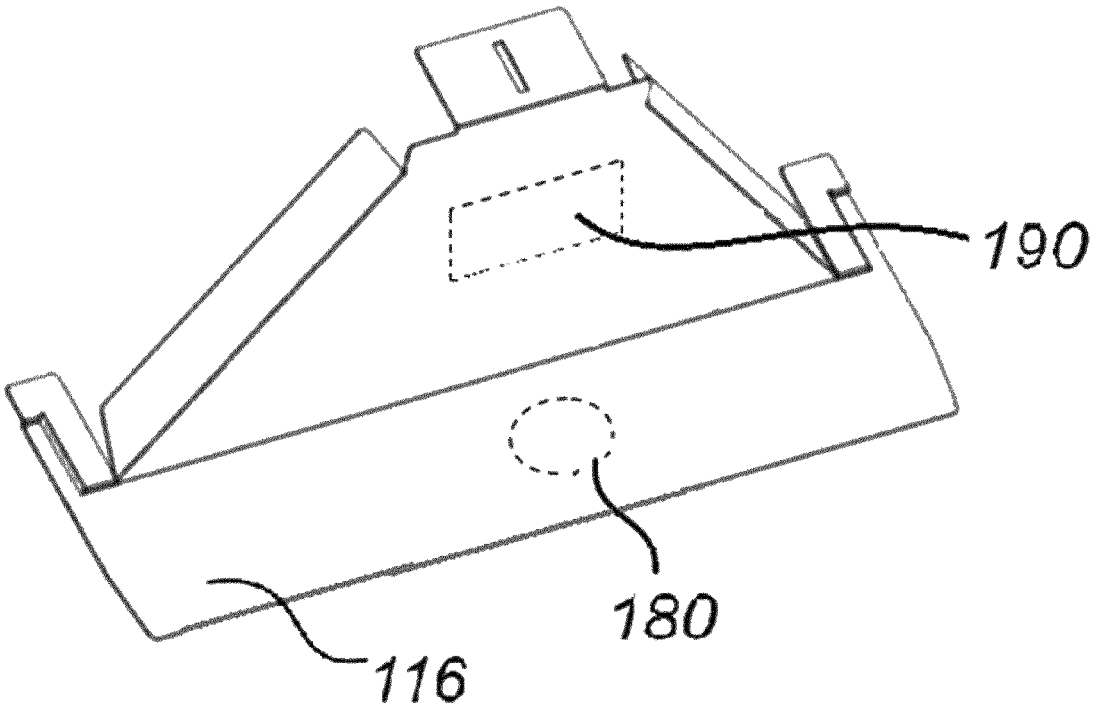
FIG. 4 is a perspective view of a sidewall parts according to an embodiment.

FIG. 4 is a perspective view of a sidewall part 116. A sensor mounting position 180 for locating a sensor (not shown), can be seen as a dashed circular outline. The outline 180 defines a cut line for a stamping or a laser cutting machine or waterjet cutting machine. The dashed line denotes a region wherein the material is almost completely cut but portions remain that offer enough mechanical strength to prevent the centre falling out during transit or installation but that is suitably weakened to allow a user or installer to push it out to allow a sensor to be fitted. The control module mounting position 190 is shown as a dashed rectangular portion and has a similarly weakened cutting pattern as that disclosed above for sensor mounting position 180.

Figure 5:
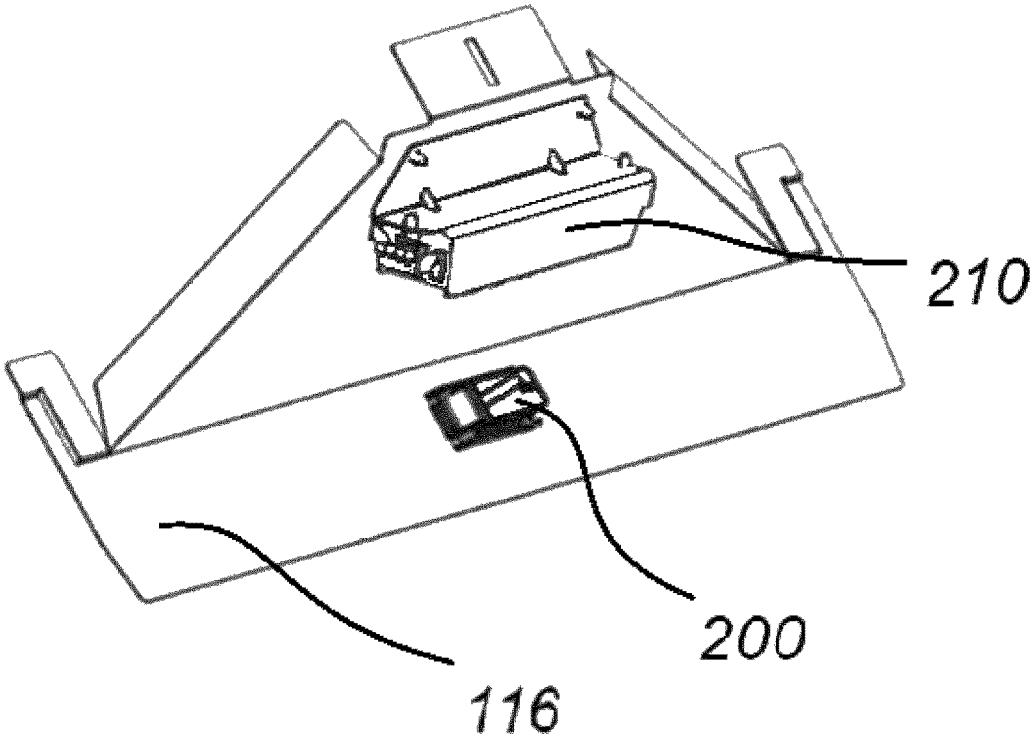
FIG. 5 is a perspective view of a sidewall parts according to an embodiment.

FIG. 5 s a perspective view of a sidewall parts 116. A sensor 200 is shown located in the sensor mounting position 180 as shown in FIG. 4. After the user or installer has pushed out the weakened portion then the sensor 200 can be affixed in position. This may be by the use of mechanical fixings such as screws or more preferably by clipping into position using a resilient tang.

A control module 210 is shown located in the control module mounting position 190 as shown in FIG. 4. After the user or installer has pushed out the weakened portion then the control module can be affixed in position. This may be by the use of mechanical fixings such as screws or more preferably by clipping into position using a resilient tang.

Figure 6:
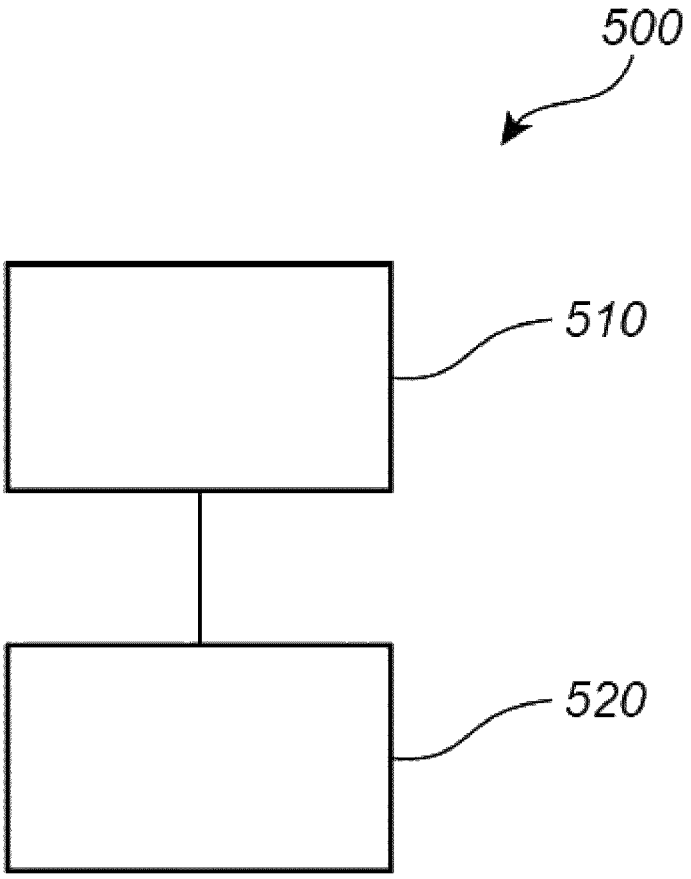
FIG. 6 is a schematic outline of a method for mounting a lighting assembly according to an embodiment.

A method 500 for mounting a lighting assembly in a lighting fixture according to an embodiment will be described with reference to FIG. 6. The lighting assembly 100 may be similarly configured as the lighting assembly 100 described with reference to FIGS. 1 to 3.

The method 500 comprises a step of arranging 510 at least four sidewall parts 110, 112, 114, 116 in the lighting fixture 170, and a step of securing 520 the sidewall parts 110, 112, 114, 116 to each other by means of a fastening arrangement 122, 124. When the sidewall parts 110, 112, 114, 116 are secured to each other, they define sidewalls of a four-sided cavity 140 and junctions between the sidewall parts 110, 112, 114, 116 are arranged at the corners of the cavity 140. Each one of at least two of the sidewall parts 110, 112, 114, 116 comprises a support surface, such as e.g. a flange 111, 113, 115, 117, adapted to support the lighting assembly 100 in the lighting fixture 170. The support surfaces are arranged to be at different sides of the four-sided cavity 140 when the sidewall parts 110, 112, 114, 116 are arranged in the lighting fixture, and may e.g. engage with a frame arranged at the lighting fixture 170 or a grid of a dropped ceiling.

The lighting assembly 100 according to the described embodiments may e.g. be a retrofit lighting assembly. Such retrofit lighting assembly may e.g. be used for modification or conversion of a luminaire already in use. As an example, a luminaire may be converted from an incandescent, fluorescent, or high intensity discharge light source into a LED light source.

The person skilled in the art realizes that the present invention by no means is limited to the preferred embodiments described above. On the contrary, many modifications and variations are possible within the scope of the appended claims. For example, the cavity 140 may be formed of more than four sidewall parts 110, 112, 114, 116. The sidewall parts 110, 112, 114, 116 may also be secured to each other by other fastening arrangements than those comprising a protruding member 122 and a receiving member 124. As an example, the sidewall parts 110, 112, 114, 116 may be attached to each other by hook-and-loop fasteners, clips, adhesive tape, etc.

Additionally, variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A lighting assembly adapted to be mounted in a lighting fixture, the lighting assembly comprising:

at least four sidewall parts;

a fastening arrangement adapted to secure the sidewall parts to each other; and at least one light emitting element, wherein:

at least one of the at least four sidewall parts is a first longitudinal sidewall part;

at least one of the at least four sidewall parts is a second longitudinal sidewall part;

at least one of the at least four sidewall parts is a first lateral sidewall part;

at least one of the at least four sidewall parts is a second lateral sidewall part;

the sidewall parts are adapted to be arranged in the lighting fixture and secured to each other such that they define sidewalls of a four-sided cavity;

at least one of the at least four sidewall parts further comprises a top wall of the four-sided cavity;

the light emitting element is arranged on the top wall of the four-sided cavity and is arranged to emit light out of said cavity;

junctions between the sidewall parts are arranged to be at the corners of the four-sided cavity when the sidewall parts are arranged in the lighting fixture; and each one of at least two of the sidewall parts comprises a support surface adapted to support the lighting assembly in the lighting fixture, the support surfaces being arranged to be at different sides of the four-sided cavity when the sidewall parts are arranged in the lighting fixture and wherein the support surfaces comprise a peripheral bent portion of the at least two sidewall parts and engage with the lighting assembly in the lighting fixture.

2. The lighting assembly as defined in claim 1, wherein at least one of the sidewall parts further comprises the cut outline of a sensor mounting hole and a small portion of the outline is not cut.

3. The lighting assembly as defined in claim 1, wherein at least one of the sidewall parts further comprises the cut outline of a control module mounting hole and a small portion of the hole is not cut.

4. The lighting assembly as defined in claim 1, further comprising a diffuser arranged to diffuse light emitted by the light emitting element.

5. The lighting assembly as defined in claim 1, wherein the fastening arrangement comprises at least one protruding member being integrally formed with at least one of the sidewall parts and at least one receiving member being integrally formed with at least another of the sidewall parts, wherein the protruding member is adapted to engage with the receiving member so as to secure the sidewall parts to each other.

6. The lighting assembly as defined in claim 5, wherein the protruding member comprises a tab and the receiving member comprises a slit, wherein the tab is adapted to be inserted in the slit and bent so as to secure the respective sidewall parts to each other.

7. The lighting assembly as defined in claim 1, wherein at least one of the at least four sidewall parts is formed by sheet metal.

8. The lighting assembly as defined in claim 1, wherein at least one of the support surfaces is integrally formed with the sidewall part.

9. The lighting assembly as defined in claim 1, wherein at least one of the support surfaces is adapted to engage with a frame arranged at a rim of the lighting fixture so as to support the lighting assembly at the lighting fixture.

10. The lighting assembly as defined in claim 1, wherein the support surface comprises a protruding flange of the sidewall part.

11. The lighting assembly as defined in claim 1, further comprising a reflective surface adapted to reflect light emitted by the light emitting element out of the cavity.

12. The lighting assembly as defined in claim 1, wherein the light emitting element comprises a light emitting diode, LED.

13. A method for mounting a lighting assembly as defined in claim 1, the method comprising:

arranging the at least four sidewall parts in the lighting fixture;

securing the sidewall parts to each other by means of the fastening arrangement such that junctions between the sidewall parts are arranged at the corners of the four-sided cavity and the support surfaces supports the lighting assembly in the lighting fixture.

14. A method for mounting a lighting assembly according to claim 13, the method further comprising;

removing a blanking portion of the sensor mounting position, removing a blanking portion of the control module mounting position, fixing a sensor in the sensor mounting position, and fixing a control module in the control module mounting position.

* * * * *